US007469668B2

(12) United States Patent
Fujii et al.

(10) Patent No.: US 7,469,668 B2
(45) Date of Patent: Dec. 30, 2008

(54) VALVE-MOVING DEVICE FOR ENGINE

(75) Inventors: Noriaki Fujii, Saitama (JP); Akiyuki Yonekawa, Saitama (JP); Katsunori Nakamura, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 37 days.

(21) Appl. No.: 10/558,872

(22) PCT Filed: May 28, 2004

(86) PCT No.: PCT/JP2004/007723

§ 371 (c)(1),
(2), (4) Date: Sep. 7, 2006

(87) PCT Pub. No.: WO2004/109066

PCT Pub. Date: Dec. 16, 2004

(65) Prior Publication Data

US 2007/0006833 A1 Jan. 11, 2007

(30) Foreign Application Priority Data

Jun. 3, 2003 (JP) ..... 2003-157774
Apr. 16, 2004 (JP) ..... 2004-121181

(51) Int. Cl.
*F01L 1/34* (2006.01)

(52) U.S. Cl. ..... 123/90.16; 123/90.15; 123/90.17; 123/90.31; 123/90.48; 123/90.53

(58) Field of Classification Search ..... 123/90.16
See application file for complete search history.

(56) References Cited

U.S. PATENT DOCUMENTS 2,791,206 A * 5/1957 Engemann ..... 123/90.45
5,365,895 A * 11/1994 Riley ..... 123/90.16
6,314,926 B1 * 11/2001 Meneely et al. ..... 123/90.16
6,546,347 B2 * 4/2003 Batchelor et al. ..... 702/94

(Continued)

FOREIGN PATENT DOCUMENTS

JP 10-18824 1/1998

(Continued)

*Primary Examiner*—Thomas E Denion
*Assistant Examiner*—Kyle M Riddle
(74) *Attorney, Agent, or Firm*—Kratz, Quintos & Hanson, LLP

(57) ABSTRACT

In an engine in which a lift amount of a valve can be changed continuously, an engine valve operating system including a valve lift-changing mechanism is capable of increasing and decreasing the lift amount of the valve without changing an opening angle for the valve and capable of decreasing a tappet clearance in accordance with a decrease in lift amount of the valve. Thus, it is possible to prevent the ratio of the tappet clearance to the lift amount at a low valve lift from being increased to minimize the influence of the dispersion of the tappet clearance and to reduce the seating speed of the valve at the low valve lift to prevent the generation of a noise. It is also possible to prevent a reduction in performance of the engine at a high valve lift due to the dispersion of the tappet clearance and to decrease the seating noise of the valve at the low valve lift.

4 Claims, 10 Drawing Sheets

U.S. PATENT DOCUMENTS 6,892,684 B2 * 5/2005 Pattakos et al. ..... 123/90.16
7,207,300 B2 * 4/2007 Ezaki et al. ..... 123/90.16

FOREIGN PATENT DOCUMENTS

JP 2003-120241 4/2003
JP 2004-36560 2/2004
WO WO 02103169 A1 * 12/2002

* cited by examiner

VALVE-MOVING DEVICE FOR ENGINE

FIELD OF THE INVENTION

The present invention relates to an engine valve operating system, which includes a valve lift-changing mechanism for continuously changing a lift amount of a valve.

BACKGROUND ART

Such an engine valve operating system is already known from Japanese Patent Application Laid-open No. 2004-036560. In this valve operating system, a rocker arm for driving the valve is pivotally supported on an engine body through two links, so that only the lift amount is changed continuously without changing the opening angle of the valve by driving one of the links by a valve-operating cam to swing the rocker arm and by moving the position of a fulcrum of the one link on the side of the engine body.

In the engine valve operating system, a predetermined tappet clearance is provided between an adjusting bolt mounted in the rocker arm and a stem end of the valve. For this reason, if the rocker arm is started to be operated to open the valve, the valve is not lifted immediately, and is started to be lifted after the rocker arm is raced in an amount corresponding to the tappet clearance to bring the adjusting bolt into abutment against the stem end.

FIG. 10 shows valve lift curves for the conventionally known valve operating system. In this valve operating system, the valve lift can be changed, but the following problem is encountered: The tappet clearance is changed neither at a high valve lift nor at a low valve lift. For this reason, the ratio of the tappet clearance to the valve lift amount in a low valve lift state is too large, and the slight dispersion of the tappet clearance largely influences an amount of air drawn and thus, lots of labor and time are required for the fine adjustment of the tappet clearance. Especially, in such an engine in which the valve lift can be changed, the valve is brought into a state of a low lift equal to or smaller than 1.5 mm during the majority of an operating time and hence, the influence of the dispersion of the tappet clearance is not negligible.

In the above-described system, a speed of seating of the valve (see an inclination L of the valve lift curve) at the low valve lift is large, as compared with a speed of seating of the valve (see an inclination H of the valve lift curve) at the high valve lift, as is apparent from a graph in FIG. 10. Therefore, there is a possibility that the seating noise of the valve might be increased, or adversely influences the durability of a valve-operating mechanism, especially at the low valve lift. In order to avoid this, if the profile of a cam is changed to provide a reduction in seating speed of the valve at the low valve lift, then the opening and closing speed of the valve at the high valve lift is reduced, resulting in a problem that the engine cannot exhibit a desired power output.

DISCLOSUSRE OF THE INVENTION

The present invention has been accomplished with the above-described circumstances in view, and it is an object of the present invention to ensure that in an engine in which the lift amount of a valve can be changed continuously, a reduction in performance of the engine at a high valve lift due to the dispersion of a tappet clearance is prevented, and the seating noise of the valve at the low valve lift is decreased.

To achieve the above object, according to a first aspect and feature of the present invention, there is provided an engine valve operating system, comprising a valve lift-changing mechanism for continuously changing the lift amount of a valve, the valve lift-changing mechanism being capable of adjusting a tappet clearance in accordance with a change in lift amount of the valve.

With such first feature, it is possible to control the valve lift amount precisely in accordance with the operating condition to prevent a reduction in performance of the engine and to prevent an increase in seating speed of the valve to provide a reduction in noise by adjusting the tappet clearance in accordance with the change in lift amount of the valve, when the lift amount of the valve in the engine is changed continuously.

According to a second aspect and feature of the present invention, in addition to the arrangement of the first feature, the valve lift-changing mechanism includes a rocker arm having a valve abutment abutting against a stem end of the valve and a cam abutment abutting against a valve-operating cam, a first link pivotally supported at one end on the rocker arm at a first fulcrum and at the other end on an engine body at a second fulcrum, a second link pivotally supported at one end on the rocker arm at a third fulcrum and at the other end on the engine body at a fourth fulcrum, and a crank member for swinging the fulcrum for pivotally supporting the other end of at least one of the first and second links about an axis parallel to an axis of rotation of a valve-operating cam, the axis about which the crank member is swung being eccentric with respect to an axis of the fulcrum for pivotally supporting the one end of the at least one link.

With such second feature, the tappet clearance can be adjusted in accordance with the change in lift amount of the valve in a simple structure in which the axis, about which the crank member is swung to change the position of the fulcrum for pivotally supporting the other end of at least one of the first and second links, is merely eccentric with the axis of the fulcrum for pivotally supporting the one end of the at least one link.

According to a third aspect and feature of the present invention, in addition to the first or second feature, the tappet clearance is decreased in accordance with a decrease in lift amount of the valve. With such arrangement, the tappet clearance is decreased in accordance with the decrease in lift amount of the valve and hence, it is possible to prevent the ratio of the tappet clearance to the lift amount at a low valve lift from being increased to suppress the influence of the dispersion of the tappet clearance to the minimum and to reduce the seating speed of the valve at the low valve lift to prevent the generation of a noise. Moreover, a large amount of air drawn can be ensured even at the low valve lift and hence, a power output from the engine at the low valve lift can be ensured.

A head cover 16 and an intake cam holder 46 in an embodiment correspond to the engine body of the present invention; an intake valve 19 in the embodiment corresponds to the valve in the present invention; an upper link 61 and a lower link 62 in the embodiment correspond to the first and second links of the present invention, respectively; an upper pin 64, a rocker arm shaft 67, a lower pin 66 and a swinging pin portion 68*a* in the embodiment correspond to the first to fourth fulcrums of the present invention, respectively; a roller 65 in the embodiment corresponds to the cam abutment of the present invention; a cam 69 in the embodiment corresponds to the valve-operating cam of the present invention; and an adjusting bolt 70 in the embodiment corresponds to the valve abutment of the present invention.

BRIEF DESCRIPTION OF DRAWINGS

FIGS. 1 to 9 show one embodiment of the present invention;

FIG. 1 is a partially vertical sectional view of an engine (a sectional view taken along a line 1-1 in FIG. 2);

FIG. 2 is a sectional view taken along a line 2-2 in FIG. 1;

FIG. 3 is a view taken along a line 3-3 in FIG. 2;

FIG. 4 is a side view of a valve lift-changing mechanism;

FIG. 5 is a perspective view of the valve lift-changing mechanism;

FIG. 6 is a view taken in the direction Of an arrow 6 in FIG. 3;

FIG. 9 is a diagram showing the relationship between a lift curve of a valve and the tappet clearance.

BEST MODE FOR CARRYING OUT THE INVENTION

Figure 1:
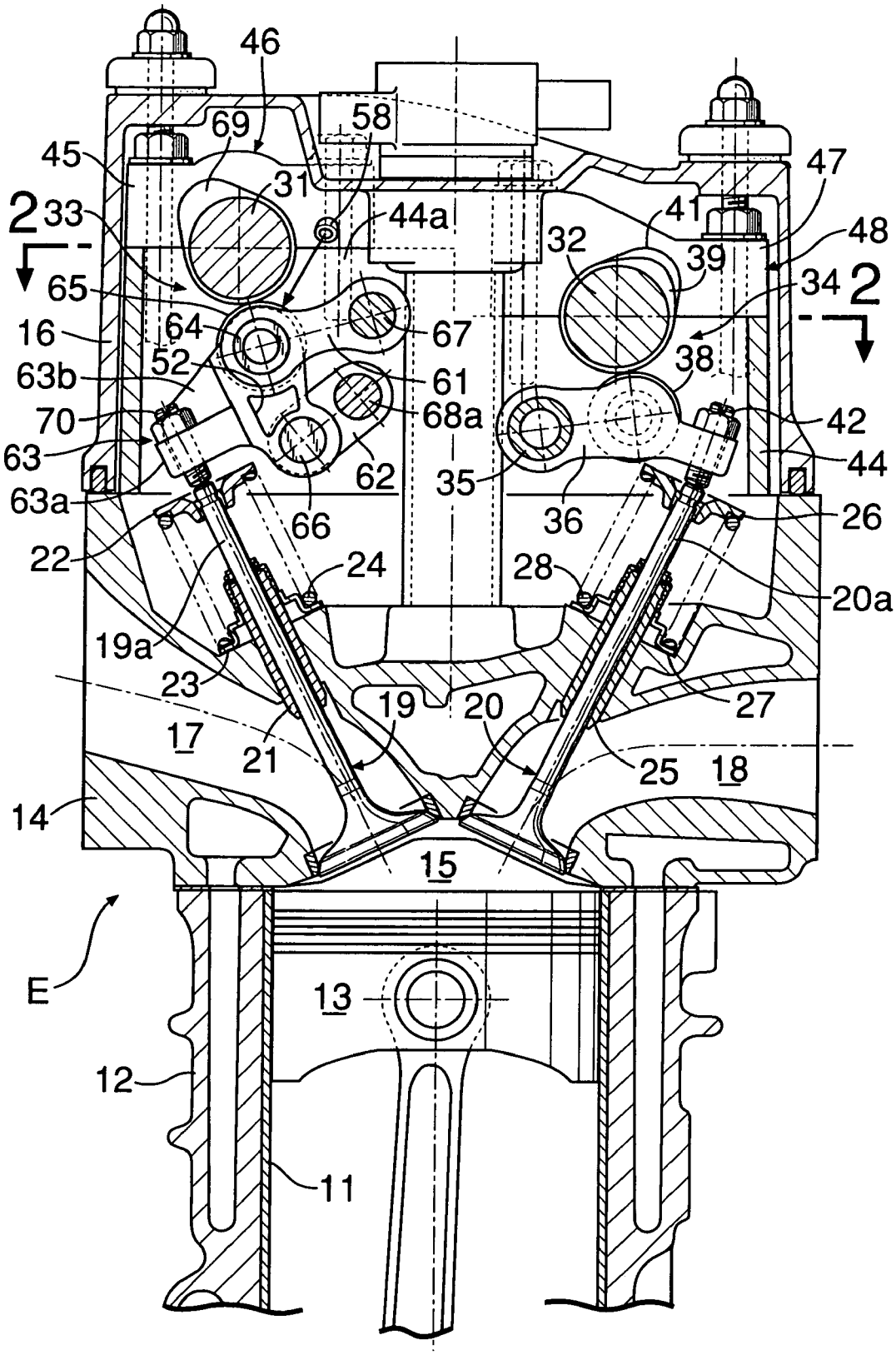

The mode for carrying out the present invention will now be described by way of an embodiment shown in the accompanying drawings. First, as shown in FIG. 1, an in-line multi-cylinder engine E includes a cylinder block 12 having cylinder bores 11 provided therein, pistons 13 slidably received in the cylinder bores 11, a cylinder head 14 coupled to a top surface of the cylinder block 12, combustion chambers 15 defined between the cylinder head 14 and pistons 13, and a head cover 16 coupled to a top surface of the cylinder head 14. An intake port 17 and an exhaust port 18 are formed in the cylinder head 14 to communicate with each of the combustion chambers 15. The Intake port 17 is opened and closed by two intake valves 19, 19, and the exhaust port 18 is opened and closed by two exhaust valves 20, 20. Each of the intake valves 19 has a stem 19*a* which is slidably received in a valve guide 21 provided in the cylinder head 14 and biased in a valve-closing direction by a valve spring 24 disposed between upper and lower spring seats 22 and 23. Each of the exhaust valves 20 has a stem 20*a* which is slidably received in a valve guide 25 provided in the cylinder head 14 and biased in a valve-closing direction by a valve spring 28 disposed between upper and lower spring seats 26 and 27.

Figure 2:
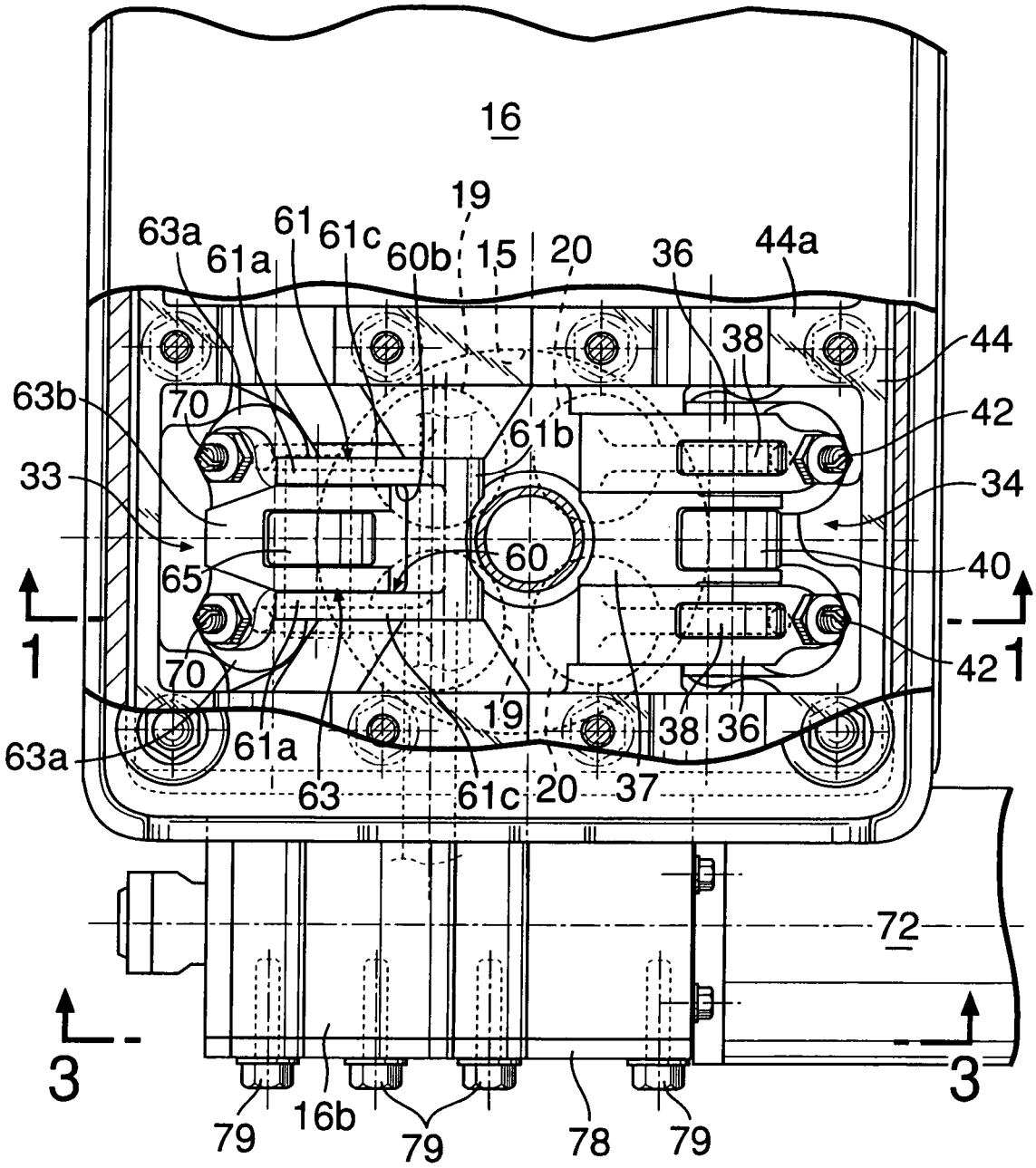

Referring also to FIG. 2, the cylinder head 14 is integrally provided with a holder 44 having support walls 44*a* disposed on opposite sides of each cylinder, and caps 45 and 47, which form an intake cam holder 46 and an exhaust cam holder 48 by cooperation with each other, are coupled to the respective support walls 44*a*. An intake camshaft 31 is rotatably supported in the intake cam holder 46, and an exhaust camshaft 32 is rotatably supported in the exhaust cam holder 47. The intake valves 19, 19 are driven by the intake camshaft 31 through a valve-lift changing mechanism 33, and the exhaust valves 20, 20 are driven by the exhaust camshaft 32 through a valve-lift/valve-timing changing mechanism 34.

The valve-lift/valve-timing changing mechanism 34 for driving the exhaust valves 20, 20 is well-known, and the outline thereof is herein explained. One end of each of two rocker arms 36, 36 for a low speed and one end of a single rocker arm 37 for a high speed are pivotally supported on an exhaust rocker arm shaft 35 supported in the support wall 44*a* in the exhaust cam holder 48. Two cams 39, 39 for the low speed provided on the exhaust camshaft 32 abut against rollers 38, 38 mounted at an intermediate portion of the low-speed rocker arms 36, 36, and a cam 41 for the high speed provided on the exhaust camshaft 32 abuts against a roller 40 mounted at an intermediate portion of the high-speed rocker arm 37. Adjusting bolts 42, 42 mounted at the other ends of the low-speed rocker arms 36, 36 abut against stem ends of the exhaust valves 20, 20.

When the low-speed rocker arms 36, 36 and the high-speed rocker arm 37 are decoupled from each other by a hydraulic pressure during operation of the engine E at a low speed, the low-speed rocker arms 36, 36 are driven by the corresponding low-speed cams 39, 39, and the exhaust valves 20, 20 are opened and closed at a low valve lift and at a low opening angle. When the low-speed rocker arms 36, 36 and the high-speed rocker arm 37 are integrally coupled to each other by a hydraulic pressure during operation of the engine E at a high speed, the high-speed rocker arm 37 is driven by the corresponding high-speed cam 41, and the exhaust valves 20, 20 are opened and closed at a high valve lift and at a high opening angle by the low-speed rocker arms 36, 36 coupled to the high-speed rocker arm 37. In this manner, the valve lift and the valve timing of the exhaust valves 20, 20 are controlled at two levels by the valve-lift/valve-timing changing mechanism 34.

The structure of the valve-lift changing mechanism 33 will be described below with reference to FIGS. 3 to 6. The valve-lift changing mechanism 33 includes a bifurcated upper link 61, a lower link 62 formed at a length shorter than that of the upper link 61 and disposed below the upper link 61, and a rocker arm 63.

The upper link 61 is formed into a substantially U-shape having a pair of first connecting portions 61*a*, 61*a*, between which the rocker arm 63 is sandwiched from opposite sides, a cylindrical stationary support portion 61*b*, and a pair of arm portions 61*c*, 61*c* which connect the first connecting portions 61*a*, 61*a* and the stationary support portion 61*b* to each other.

The rocker arm 63 is provided, at one end thereof, with a pair of bolt-mounting portions 63*a*, 63*a*, in which adjusting bolts 70, 70 abutting against upper ends of the stems of the pair of intake valves 19, 19 from the above are threadedly fitted, so that their advanced and retracted positions can be adjusted. The other end of the rocker arm 63 is formed into a substantially U-shape so as to be widened to a side opposite from the intake valves 19, 19, and a first support portion 63*c* for turnably connecting one end of the upper link 61 and a second support portion 63*d* for turnably connecting one end of the lower link 61 are provided at the other end of the rocker arm 63 in such a manner than the second support portion 63*d* is disposed below the first support portion 63*c*. Moreover, A roller 65 which is in rolling contact with the cam 69 on the intake camshaft 31 is disposed so that it is sandwiched between branches of the substantially U-shaped first support portion 63; and is supported on the first support portion 63*c* through an upper pin 64 coaxially with the connection at one end of the upper link 61.

Moreover, a rib 63*b* is projectingly provided at an upper portion of the rocker arm 63, so that it is located between the bolt-mounting portions 63*a*, 63*a* and extends over between one end of the rocker arm 63 and the other end of the rocker arm 63, i.e., a portion at which the roller 65 is disposed.

The rocker arm 63 is formed so that a width at one end on a direction along an axis of rotation of the cam 69, i.e., a distance between outer ends of the bolt-mounting portions

63*a*, 63*a* along the axis of rotation is larger than a width of the other portion. The widths of the first and second support portions 63*c* and 63*d* are equal to each other.

The first connecting portions 61*a*, 61*a* at the one end of the upper link 61 are turnably connected to the other end of the rocker arm 63 through the upper pin 64 inserted through and fixed in a first connecting bore 49 provided in the first support portion 63*c* of the rocker arm 63, and an outer side of a portion of the other end of the rocker arm 63, which is opposed to the intake camshaft 31, as well as outer sides of the first connecting portions 61*a*, 61*a* at the one end of the upper link 61 are formed into an arcuate shape about an axis of the upper pin 64 in such a manner that they are superposed on each other as viewed from the side.

The lower link 62 disposed below the upper link 61 has a second connecting portion 62*a* at one end thereof and a movable support portion 62*d* at the other end thereof, and is formed into a flat plate-shape in such a manner that it is disposed between both of the arm portions 61*c*, 61*c* of the upper link 61, as viewed in a direction perpendicular to a straight line L1 connecting rotational axes of the opposite ends of the upper link 61. The second connecting portion 62*a* disposed so as to be sandwiched between the branches of the substantially U-shaped second support portion 63*d* is turnably connected to the second support portion 63*d* at the other end of the rocker arm 63 through a lower pin 66 which is inserted through and fixed in a second connecting bore 50 provided in the second support portion 63*d* below the upper pin 64.

In other words, the rocker arm 63 having the roller 65 abutting against the cam 69 at the upper portion at the other end thereof is operatively connected at one end to the pair of intake valves 19, 19. The first connecting portions 61*a*, 61*a* provided at one end of the upper link 61 and the second connecting portion 62*a* provided at one end of the lower link disposed below the upper link 61 are relatively turnably connected in a vertically parallel relation to the other end of the rocker arm 63.

The stationary support portion 61*b* at the other end of the upper link 61 is turnably supported on the rocker arm shaft 67 fixed to the camshaft holder 29, and the movable support portion 62*b* provided at the other end of the lower link 62 is turnably supported by a swinging pin portion 68*a*. Moreover, the lower link 62 is formed at the length shorter than that of the upper link 61, and the movable support portion 62*b* at the other end of the lower link 62 is disposed at a location nearer to the intake valves 19, 19 than the stationary support portion 61*b* at the other end of the upper link 61.

The swinging pin portion 68*a* is provided on a crank member 68, which comprises the swinging pin portion 68*a* and a support shaft portion 68*c* provided at right angles at opposite ends of a connecting plate portion 68*b* disposed in a plane parallel to a plane of operation of the lower link 62 to protrude in directions opposite from each other. The support shaft portion 68*c* is turnably supported in a support bore 16*a* provided in the head cover 16.

Figure 4:
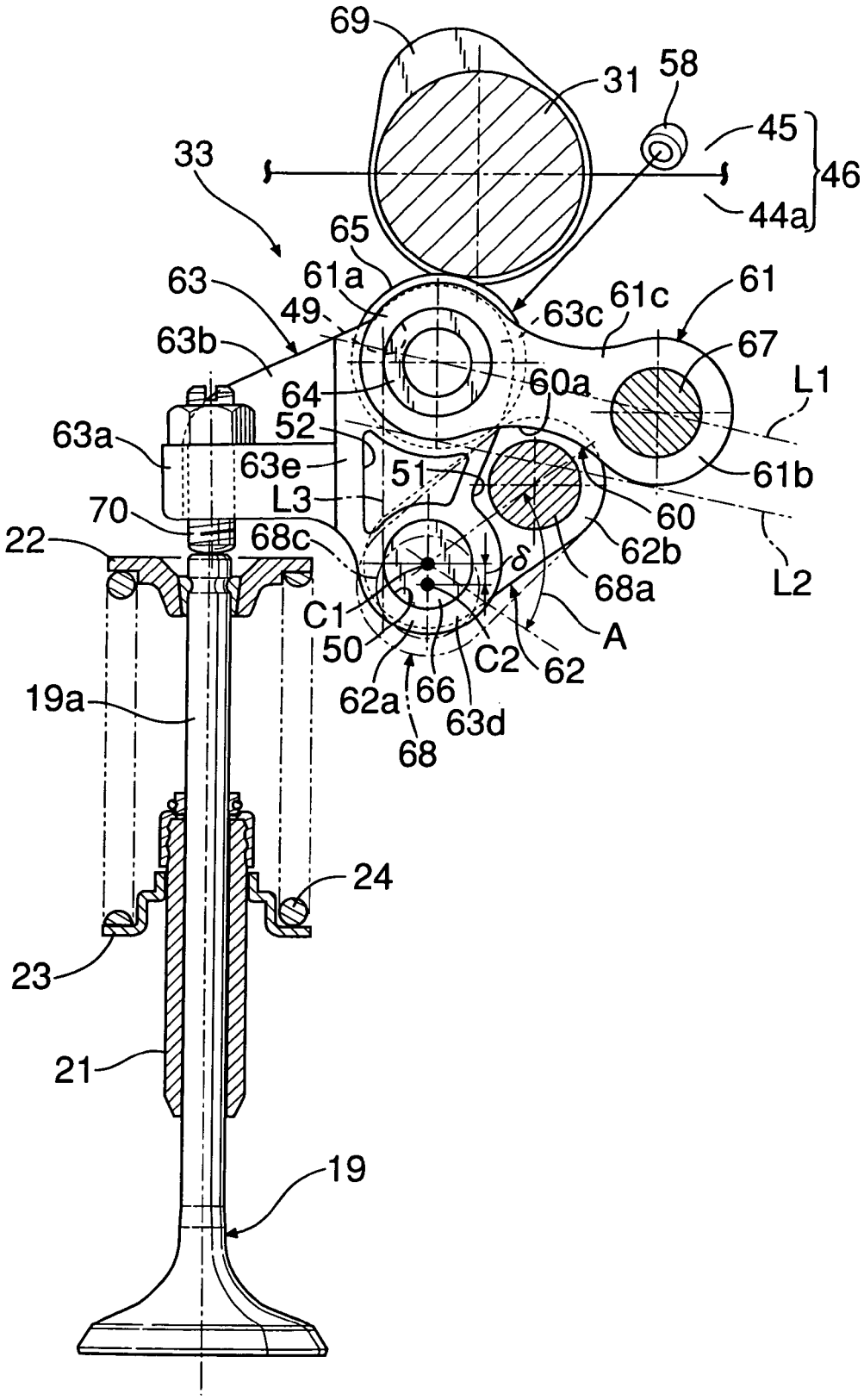
Figure 5:
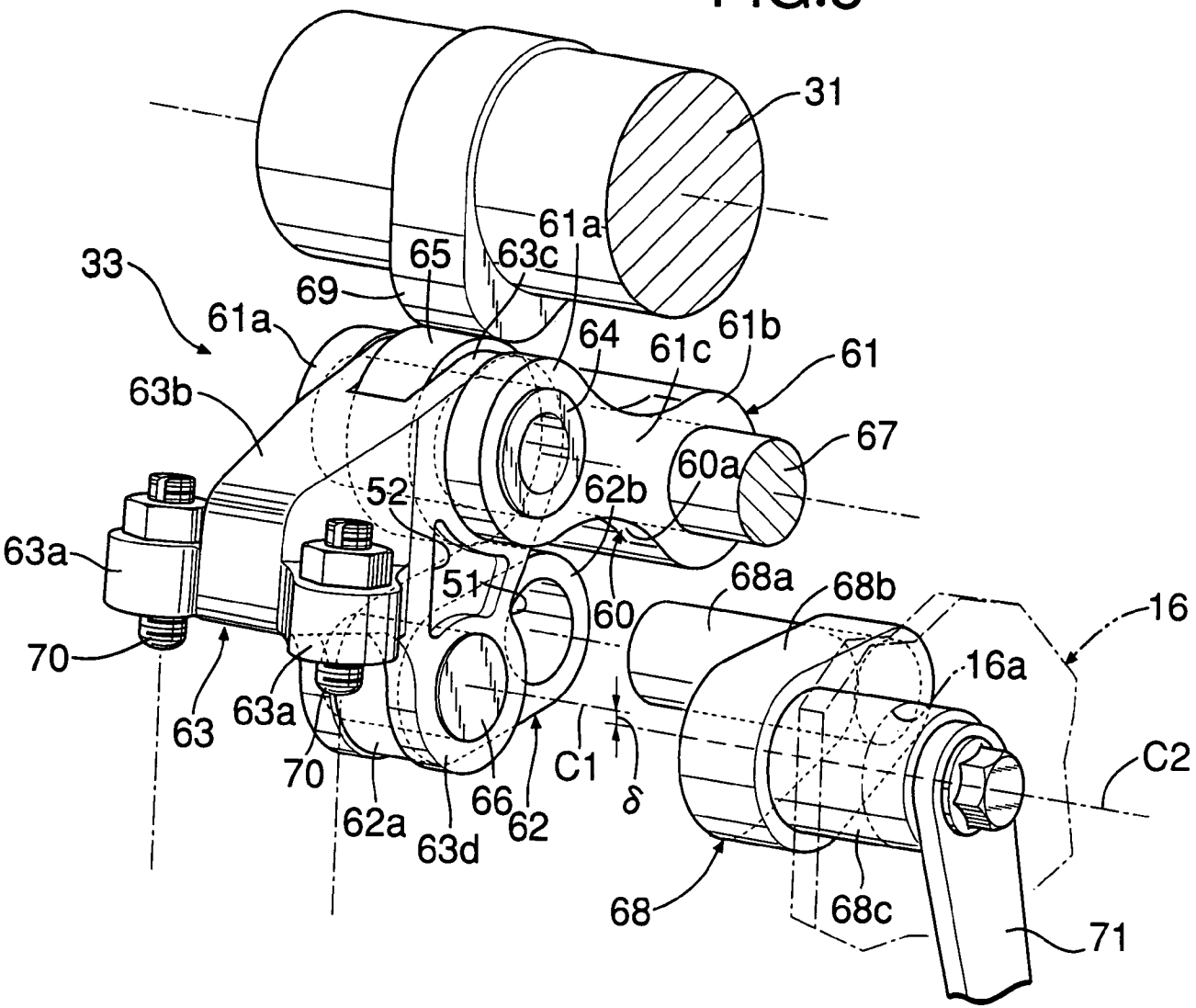
Figure 6:
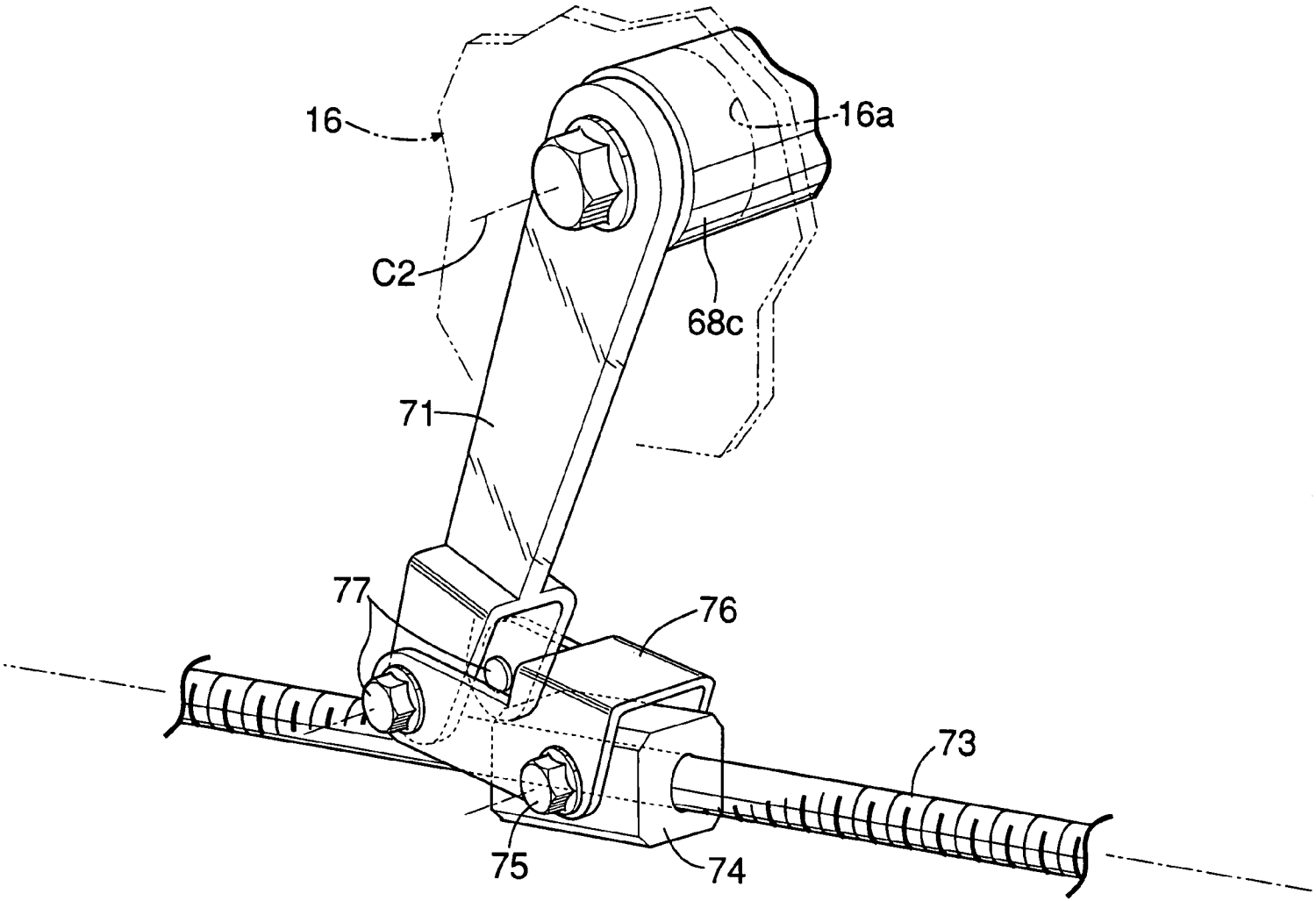
Figure 8B:
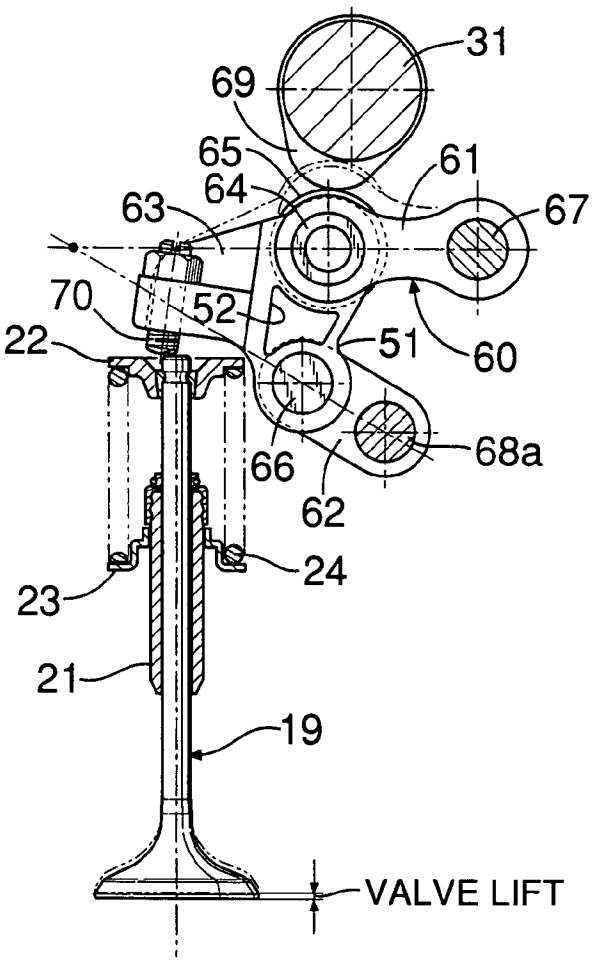
FIGS. 8A and 8B are views for explaining the changing of a valve lift.
Figure 8A:
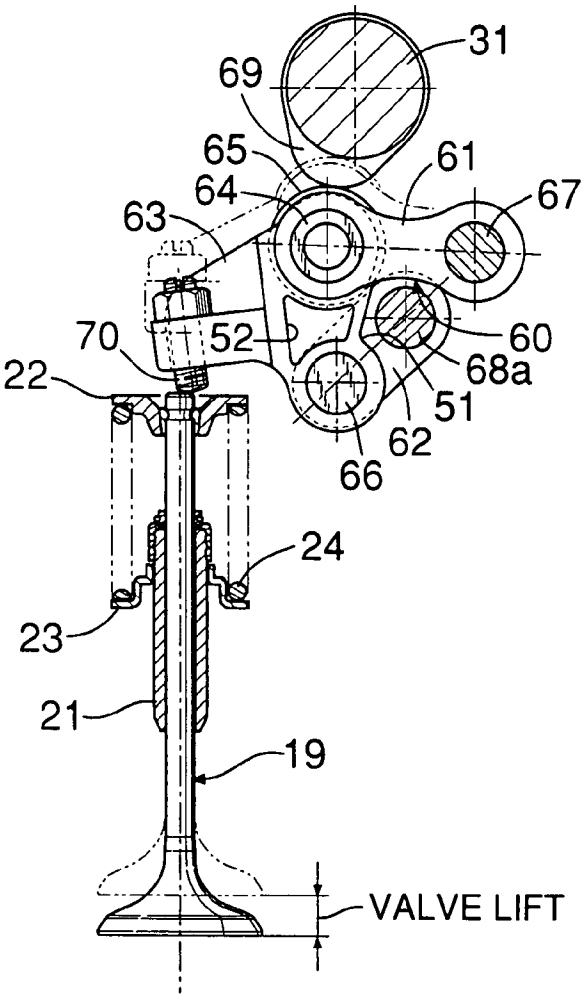

In a high valve-lift state in which the swinging pin portion 68*a* is in a position shown in FIG. 8A, an axis C2 of the support shaft portion 68*c* of the crank member 68 is slightly eccentric downwards by δ, as shown in FIGS. 4 and 5, with respect to an axis C1 of the lower pin 66 for pivotally supporting the lower link 62 on the rocker arm 63.

An accommodating portion 60 capable of accommodating the movable support portion 62*b* is formed on the upper link 61 in such a manner that a portion of the movable support portion 62*b* is superposed, as viewed from the side, on a straight line L2 interconnecting side faces of the first connecting portion 61*a*, 61*a* and the fixed support portion 61*b* of the upper link 61 on the side of the lower link 62, in a state in which at least the movable support portion 62*b* at the other end of the lower link 62 is nearest to the upper link 61.

The accommodating portion 60 comprises an opening 60*a* formed between both of the arm portions 61*c*, 61*c* of the upper link 61 to be able to accommodate a portion of the movable support portion 62*b*, and recesses 60*b* formed in lower portions of the arm portions 61*c*, 61*c* to be able to accommodate at least a portion of the swinging pin portion 68*a*. The upper link 61 is formed into a gourd-shape as viewed from the side to form the recesses 60*b*.

The rocker arm 63 is integrally provided with a pair of connecting walls 63*e* which interconnect the first and second substantially U-shaped support portions 63*c* and 63*d*. Moreover, the connecting walls 63*e* is formed to interconnect the first and second support portions 63*b* and 63*c* in such a manner that at least a portion thereof is disposed on a side opposite from the intake valves 19, 19 with respect to a tangent line L3 tangent to outer edges of the first and second connecting bores 49 and 50 on the side of the intake valves 19, 19.

A recess 51 is formed in the connecting wall 63*e* in such a manner that the movable support portion 62*b* at the other end of the lower link 62 is disposed at a location opposed to the movable shaft 68*a* in a state in which it is nearest to the rocker arm 63. Further, lightening portions 52 are formed on the connecting walls 63*e* in such a manner that they are recessed, for example, inwards from outer sides.

The support shaft portion 68*c* of the crank member 68 protrudes from the support bore 16*a* in the head cover 16, and a control arm 71 is fixed to a tip end of the support shaft portion 68*c* and driven by an actuator motor 72 mounted to an outer wall of the cylinder head 14. More specifically, a nut member 74 is meshed with a threaded shaft 73 rotated by the actuator motor 72, and a connecting link 76 pivotally supported at one end on the nut member 74 by a pin 75 is connected at the other end to the control arm 71 through pins 77, 77. Therefore, when the actuator motor 72 is operated, the nut member 74 is moved along the rotated threaded shaft 73, and the crank member 68 is swung about the support shaft portion 68*c* by the control arm 71 connected to the nut member 74 through the connecting link 76, whereby the swinging pin portion 68*a* is moved between a position shown in FIG. 7A and a position shown in FIG. 7B.

The threaded shaft 73, the nut member 74, the pin 75, the connecting link 76, the pins 77, 77 and the control arm 71 are accommodated inside the walls 14*a* and 16*b* protruding the side faces of the cylinder block 14 and the head cover 16, and a cover 78 covering end faces of the walls 14*a* and 16*b* is fixed to the walls 14*a* and 16*b* by bolts 79.

An oil is supplied from an oil jet 58 toward upper one 64 of the upper pin 64 and the lower pin 66 which are disposed at locations where they are vertically arranged, in such a manner that they connect the first connecting portion 61*a* of the upper link 61 and the second connecting portion 62*a* of the lower link 62 to the other end of the rocker arm 63. The oil jet 58 is fixedly mounted to the cap 45 in the intake cam holder 46.

The operation of the embodiment having the above-described arrangement will be described below. When the control arm 71 is swung to a position shown by a solid line in FIG. 3 by the actuator motor 72, the crank member 68 (see FIG. 5) connected to the control arm 71 is rotated in a counterclockwise direction, and the swinging pin portion 68*a* of the crank member 68 is lifted, as shown in FIG. 8A, whereby the shape of a quadric linkage connecting the rocker arm shaft 67, the upper pin 64, the lower pin 66 and the swinging pin portion 68*a* to one another is substantially triangular. When the roller 65 is pushed by the cam 69 provided on the intake camshaft 31 in this state, the quadric linkage is deformed, so that the rocker arm 63 is swung downwards from a position shown by a dashed line to the position shown by the solid line, and the adjusting bolts 70, 70 push the stem ends of the intake valves 19, 19 to open the intake valves 19, 19 at a high valve lift.

Figure 3:
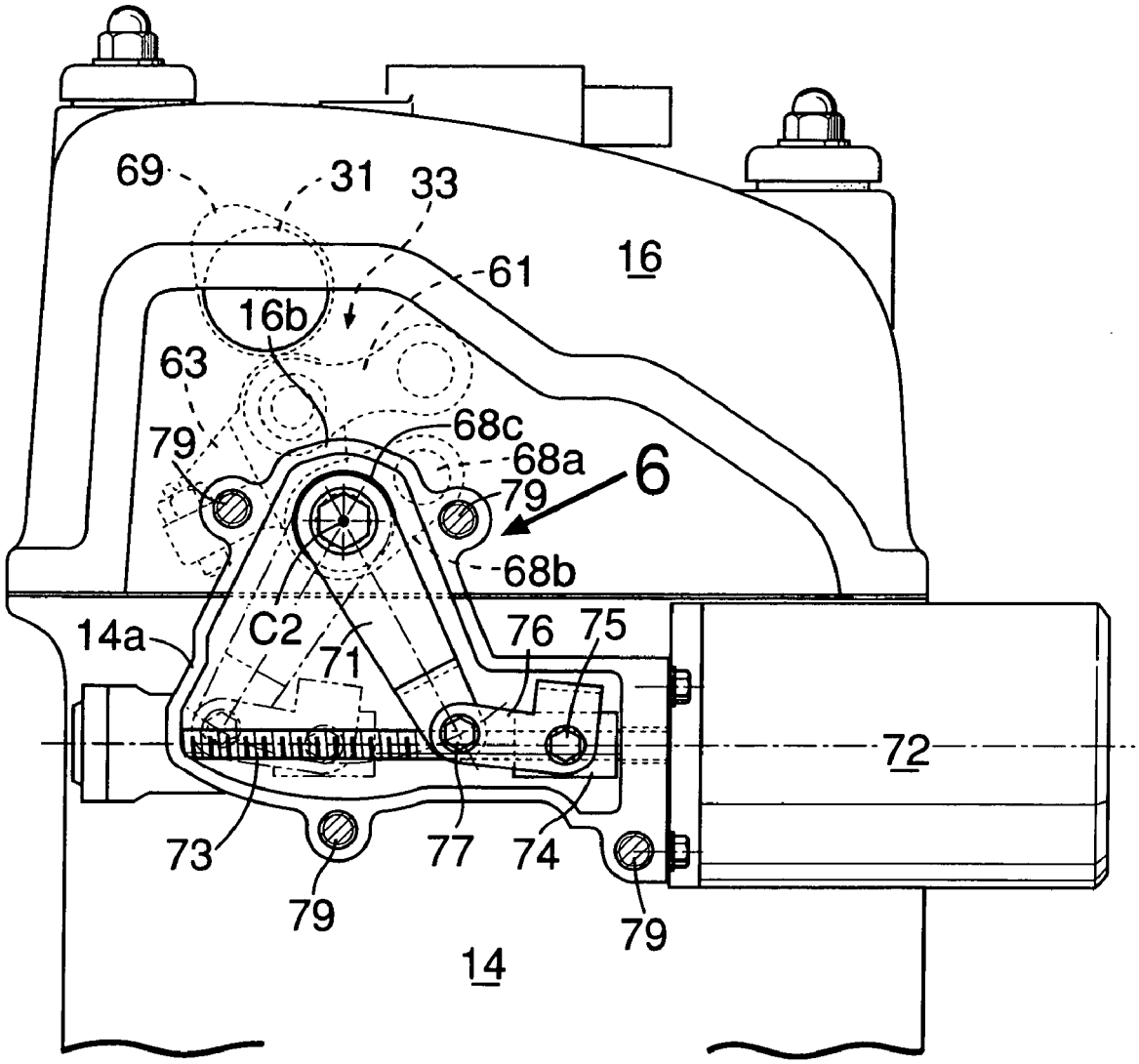

When the control arm 71 is swung to the position shown by the dashed line FIG. 3 by the actuator motor 72, the crank member 68 connected to the control arm 71 is rotated in a clockwise direction, and the swinging pin portion 68*a* of the crank member 68 is lowered, as shown in FIG. 8B, whereby the quadric linkage connecting the rocker arm shaft 67, the upper pin 64, the lower pin 66 and the swinging pin portion 68*a* to one another is substantially trapezoidal. When the roller 65 is pushed by the cam 69 provided on the intake camshaft 31 in this state, the quadric linkage is deformed, so that the rocker arm 63 is swung downwards from the position shown by the dashed line to the position shown by the solid line, and the adjusting bolts 70, 70 push the stem ends of the intake valves 19, 19 to open the intake valves 19, 19 at a low valve lift.

Figure 9:
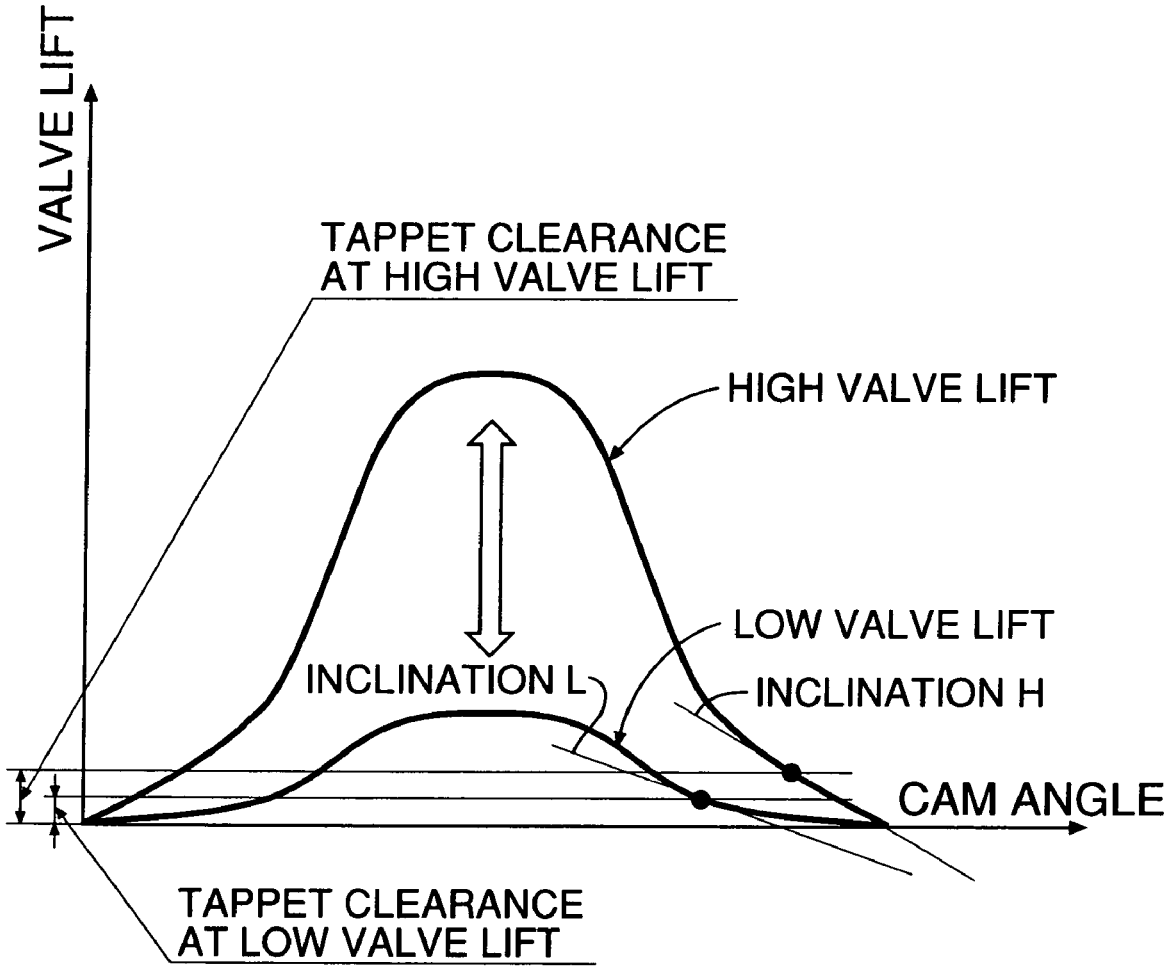
Figure 10:
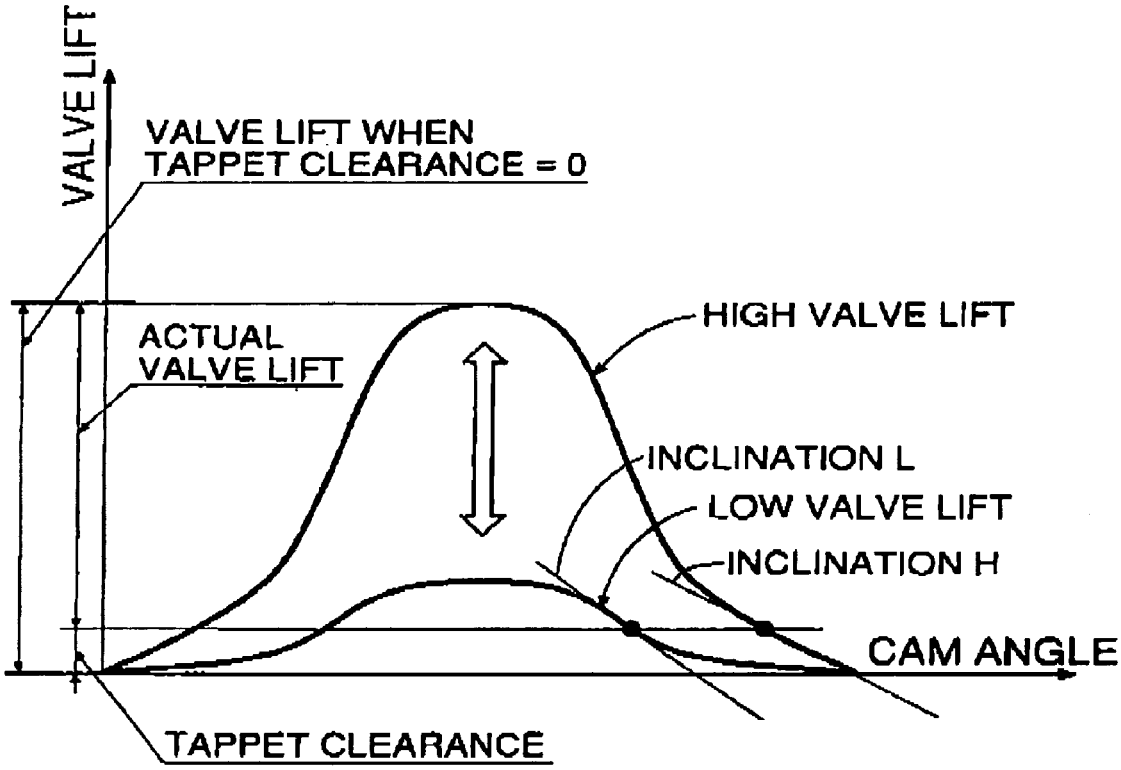
FIG.10 PRIOR ART
FIG. 10 is a diagram showing valve lift curves for the conventionally known valve operating system.

As a result, only the valve lift amount can be changed continuously, while ensuring that the opening angle at the high valve lift corresponding to the FIG. 8A and the opening angle at the low valve lift corresponding to FIG. 8B remain maintained at the same value, as can be seen from valve lift curves for the intake valves 19, 19 shown in FIG. 9.

By ensuring that the axis C2 of the support shaft portion 68*c* of the crank member 68 is eccentric by δ with respect to the axis C1 of the lower pin 66 pivotally supporting the lower link 62 on the rocker arm 63, a tappet clearance of each of the intake valves 19, 19 is increased and decreased with an increase and a decrease in valve lift amount.

Figure 7B:
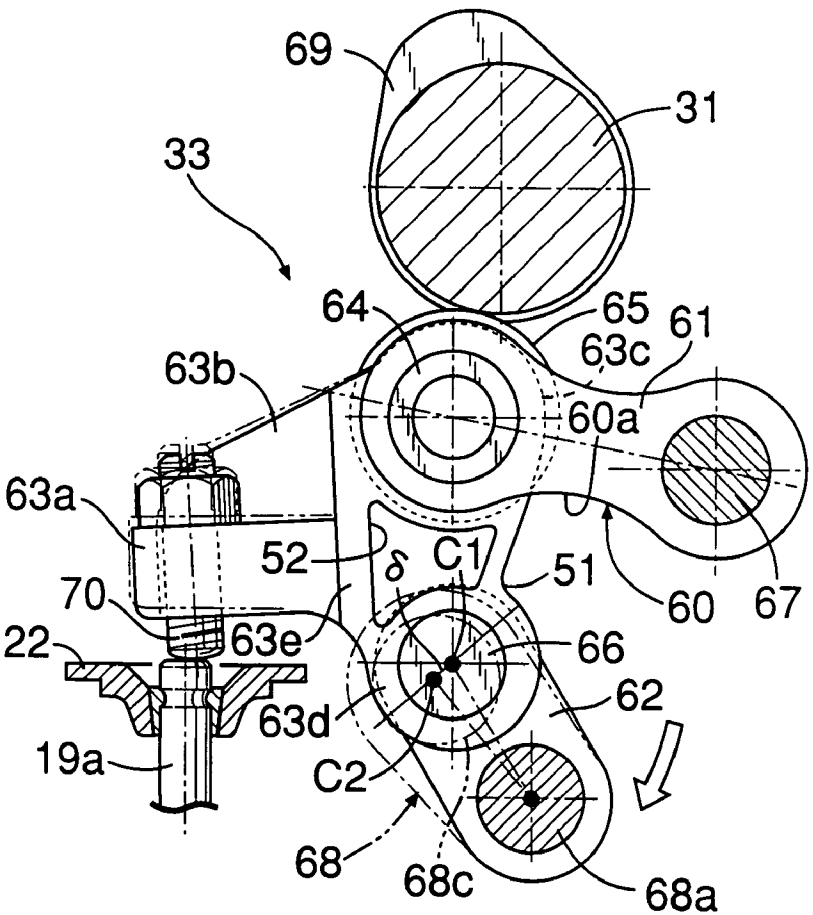
FIGS. 7A and 7B are views for explaining the changing of a tappet clearance.
Figure 7A:
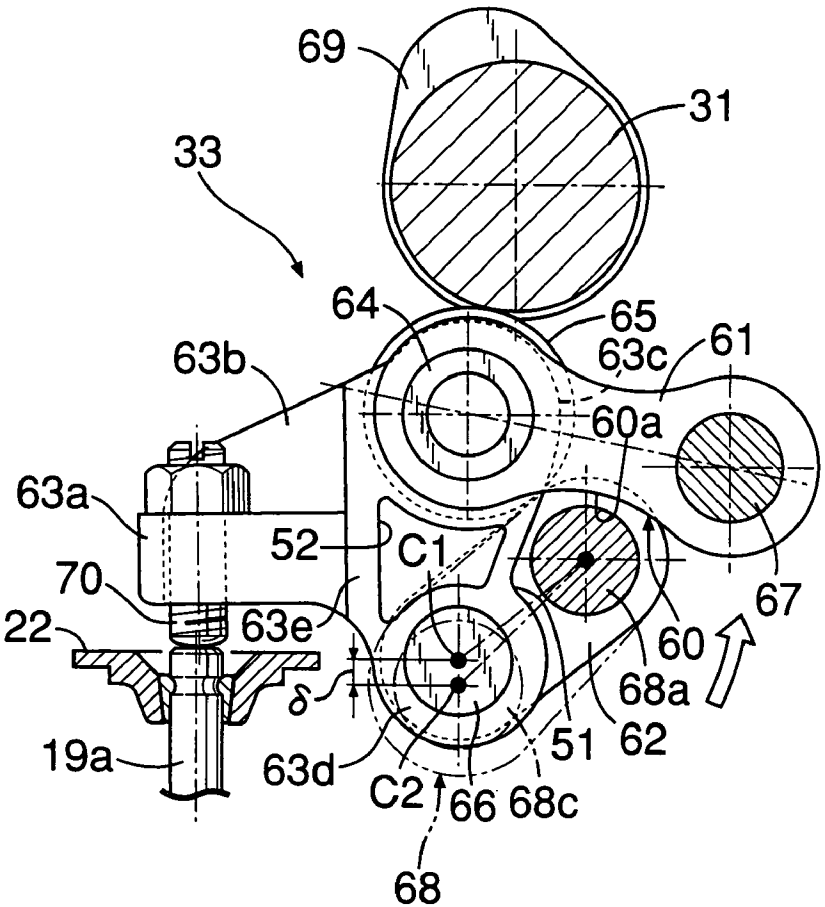

This will be described with reference to FIGS. 7A and 7B. F*ig*. 7A shows a high valve lift state in which the crank member 68 has been swung in the counterclockwise direction, whereby the end of the lower link 62 closer to the swinging pin portion 68*a* has been lifted, and FIG. 7B shows a low valve lift state in which the crank member 68 has been swung in the clockwise direction, whereby the end of the lower link 62 closer to the swinging pin portion 68*a* has been lowered. As can be seen by comparison of FIGS. 7A and 7B with each other, in the low valve lift state shown in F*ig*. 7B, the position of the rocker arm 63 has been slightly lowered to the position shown by the solid line with respect to the position shown by the dashed line (the position in the high valve lift state shown in FIG. 7A). It follows that the tappet clearance between each of the adjusting bolts 70, 70 and each of the stem ends of the intake valves 19, 19 is correspondingly decreased.

As shown in FIG. 9, the tappet clearance at the low valve lift is small, as compared with the tappet clearance at the high valve lift. Therefore, it is possible to suppress the influence of the dispersion of the tappet clearance to the minimum to prevent a reduction in performance of the engine E by suppressing the relative increase in ratio of the tappet clearance to the lift amount of the intake valves 19, 19 at the low valve lift. Moreover, it is possible to prevent the seating speed (see an inclination L of the valve lift curve) of the intake valves 19, 19 at the low valve lift from being increased with respect to the seating speed (see an inclination H of the valve lift curve) of the intake valves 19, 19 at the high valve lift, thereby reducing the seating noise at the low valve lift. Further, a large amount of air drawn can be ensured even at the low valve lift and hence, a power output from the engine E at the low valve lift can be ensured.

In addition, the rocker arm 63 is provided at one end with the pair of bolt-mounting portions 63*a*, 63*a*, with which the adjusting bolts 70, 70 abutting respectively pair of intake valves 19, 19 are meshed, so that their advanced and retracted positions can be adjusted, and the rib 63*b* is projectingly provided on the rocker arm 63, so that it is disposed between both of the bolt-mounting portions 63*a*, 63*a* and extends from the one end of the rocker arm 63 and the portion at which the roller 65 is disposed. Therefore, it is possible to provide an increase in rigidity of the rocker arm 63.

The upper link 61 includes the pair of first connecting portions 61*a*, 61*a* between which the rocker arm 63 is sandwiched from the opposite sides, the stationary support portion 61*b* and the pair of arm portions 61*c*, 61*c* connecting the first connecting portions 61*a*, 61*a* and the stationary support portion 61*b* to each other, and the lower link 62 is formed into the flat plate-shape in such a manner that it is disposed between the arm portions 61*c*, 61*c*, as viewed in the direction perpendicular to the straight line L1 connecting the rotational axes of the opposite ends of the upper link 61 to each other. Therefore, it is possible to a decrease in weight of the lower link 62, while ensuring the rigidity of the lower link 62 by forming the lower link 62 into a flat shape on which a larger load is applied than on the upper link 61, while enabling a decrease in weight and the compactness of the upper link taking charge of a small load as compared with the lower link 62.

Moreover, the accommodating portion 60 capable of accommodating the movable support portion 62*b* is formed on the upper link 61 in such a manner that a portion of the movable support portion 62*b* is superposed, as viewed from the side, on the straight line L2 interconnecting the side faces of the first connecting portions 61*a*, 61*a* and the stationary support portion 61*b* of the upper link 61 closer to the lower link 62 in the state in which at least the movable support portion 62*b* is nearest to the upper link 61. Therefore, the valve operating system can be formed compactly in such a manner that the upper and lower links 61 and 62 are mounted at locations closer to each other, while enabling the amount of movable support portion 62*b* displaced to be set at a relatively large value to increase the amount of lift changed for the intake valves 19, 19. Moreover, a portion of the accommodating portion 60 is formed between both of the arm portions 61*c*, 61*c* and hence, a further compactness can be provided by mounting the upper and lower links 61 and 62 at the location closer to each other. Further, because the accommodating portion 60 is formed so that it can accommodate at least a portion of the swinging pin portion 68*a* therein, the valve operating system can be formed further compactly by mounting the upper and lower links 61 and 62 at locations further closer to each other.

The first and second connecting portions 61*a* and 61*b* at one end of each of the upper link 61 and the lower link 62 are relatively turnably connected in a vertical arrangement to the other end of the rocker arm 63 is operatively connected at one end thereof to the intake valves 19, 19. The lower link 62 is formed at the length shorter than that of the upper link 61, and the movable support portion 62*b* at the other end of the lower link 62 is disposed at the location closer to the intake valves 19, 19 than the stationary support portion 61*b* at the other end of the upper link 61. Therefore, a moment of a reaction force applied from the lower link 62 to the control arm 71 through the crank member 68 can be suppressed to a relatively small value by the principle of leverage, and a load applied to the control arm 71 and the actuator motor 72 can be reduced to contribute to enhancements in reliability and durability of the control arm 71 and the actuator motor 72.

The first connecting portions 61*a*, 61*a* at the one end of the upper link 61 are turnably connected to the rocker arm 63 through the upper pin 64, and the roller 65 is axially supported on the rocker arm 63 through the upper pin 64, and the outer side faces of the portion of the rocker arm 63 opposed to the intake camshaft 31 as well as the outer sides of the first connecting portions 61*a*, 61*a* at the one end of the upper link 61 are each formed into the arcuate shape about the axis of the upper pin 64 in such a manner that they are superposed on each other, as viewed from the side. Therefore, the upper link 61 can be turnably connected at one end in a compact disposition to the rocker arm 63, while avoiding the occurrence of the interference of the rocker arm 63 and the upper link 61 with the intake camshaft 31.

Further, the valve lift changing mechanism 33 includes the crank member 68 which comprises the swinging pin portion 68*a* and the support shaft portion 68*c* having the axis parallel to the swinging pin portion 68*a*, which are projectingly provided at the opposite ends of the connecting plate portion 68*b*, and the support shaft portion 68*c* is turnably supported on the head cover 16. Therefore, the swinging pin portion 68*a* can be easily displaced by turning the crank member 68 about the axis of the support shaft portion 68*c* and thus, a mechanism for displacing the swinging pin portion 68*a* by the actuator motor 72 can be simplified.

Moreover, the rocker arm 63 including the pair of bolt-mounting portions 63*a*, 63*a* with which the tappet screws 70 abutting respectively against the pair of intake valves 19 are engaged so that their advanced and retracted positions can be adjusted, and the first and second support portions 63*c* and 63*d* which turnably connect the upper link 61 and the lower link 62 at one ends to each other, is formed so that the width at one end in the direction along the turning axis of the cam 69, i.e., the distance between the outer ends of the bolt-mounting portions 63*a*, 63*a* along the turning axis is larger than the width at the other portion. Therefore, the width of the rocker arm 63 in the direction along the turning axis of the cam 69 can be decreased to the utmost, which also can provide the compactness of the valve operating system. In addition, the rocker arm 63 is formed so that the first and second support portions 63*c* and 63*d* have the same width and hence, the rocker arm 63 can be formed compactly, while being simplified in shape.

The first support portion 63*c* provided on the rocker arm 63 is formed into the substantially U-shape in such a manner that the roller is sandwiched from the opposite sides, and the roller 65 is rotatably supported on the first support portion 63*c*. Therefore, the entire rocker arm 63 including the roller 65 can be formed compactly. Moreover, the upper link 61 is provided at one end with the pair of first connecting portions 61*a*, between which the first support portion 63*c* is sandwiched from the opposite sides, and the first connecting portions 61*a* are turnably connected to the first support portion 63*c* through the upper pin 64, and the roller 65 is axially supported on the first support portion 63*c* through the upper pin 64. Therefore, a reduction in number of parts can be provided and the valve operating system can be formed more compactly by ensuring that the rotatable connection of the one end of the upper link 61 to the first support portion 63*c* and the supporting of the roller 65 on the first support portion 63*c* are achieved in virtue of the common upper pin 64.

The first and second connecting bores 49 and 50, through which the upper pin 64 and the lower pin 65 for turnably connecting the one ends of the upper link 61 and the lower link 62 to each other are inserted, are provided in the first and second support portions 63*c* and 63*d* of the rocker arm 63, so that they are arranged in opening and closing directions of the intake valves 19, 19, and the first and second support portions 63*c* and 63*d* are interconnected by the connecting wall 63*e*, at least a portion of which is disposed on the side opposite from the intake valves 19 with respect to the tangent line L3 tangent to the outer edges of the first and second connecting bores 49 and 50 on the side of the intake valves 19. Therefore, the rigidity of the first and second support portions 63*c* and 63*d* can be enhanced.

The recess 51 is formed in the connecting wall 63*e* in such a manner that the second connecting portion 62*a* at the other end of the lower link 62 is opposed to the second connecting portion 62*a* in the state in which it is nearest to the rocker arm 63, and the second connecting portion 62*a* of the lower link 62 can be displaced to the position as close to the rocker arm 63 as possible. Thus, it is possible to set the maximum amount of lift for the intake valves 19, 19 at as large value as possible, while enabling the compactness of the valve operating system.

Further, the lightening portion 52 is formed on the connecting wall 63*e* and hence, an increase in weight of the rocker arm 63 can be suppressed, while enabling an increase in rigidity of the connecting wall 63*e*.

The oil is supplied from the oil jet 58 to upper one 64 of the upper pin 64 and the lower pin 65 connecting the one ends of the upper link 61 and the lower link 62 to the rocker arm 63, and the oil which has lubricated a region between the upper link 61 and the rocker arm 63 flows downwards to lubricate a region between the lower link 62 and the rocker arm 63. Therefore, both of the connections between the rocker arm 63 and the upper link 61 as well as the lower link 62 can be lubricated in a lubricating structure simplified and formed by a decreased number of parts, thereby ensuring a smooth valve operation.

Moreover, the first support portion 63*d* is provided on the rocker arm 63 and formed into the substantially U-shape in such a manner that the roller 65 is sandwiched from the opposite sides. The first connecting portions 61*a* at the one end of the upper link 61 are turnably connected to the first support portion 63*c* through the upper pin 64 for axially supporting the roller 65, and the oil jet 58 is disposed to supply the oil toward mating faces of the upper link 61 and the first support portion 63*c*. Therefore, the supported portion of the roller 65 can be also lubricated.

Further, the oil jet 58 is disposed on the cap 45 of the intake cam holder 46 which rotatably supports the intake camshaft 31 provided with the cam 69 and hence, the oil of a sufficiently high pressure and a sufficient amount can be supplied from the oil jet 58 utilizing an oil passage for lubricating the region between the intake camshaft 31 and the intake cam holder 46.

Yet further, the lift-changing mechanism 33 includes the crank member 68 which comprises the swinging pin portion 68*a* and the support shaft portion 68*c* having the axis parallel to the swinging pin portion 68*a*, which are projectingly provided at the opposite ends of the connecting plate portion 68*b*, and the support shaft portion 68*c* is turnably supported on the head cover 16. Therefore, the swinging pin portion 68*a* can be easily displaced by turning the crank member 68 about the axis of the support shaft portion 68*c*, and the mechanism for displacing the swinging pin portion 68*a* by the actuator motor 72 can be simplified.

Although the embodiment of the present invention has been described in detail, it will be understood that various modifications in design may be made in a scope which does not depart from the subject matter of the invention.

For example, the valve lift-changing mechanism 33 is applied to only the intake valves 19, 19 in the embodiment, but may be applied to only the exhaust valves 20, 20, or may be applied to both of the intake valves 19, 19 and the exhaust valves 20, 20.

What is claimed is:

1. An engine valve operating system, comprising a valve lift-changing mechanism (33) for continuously changing the lift amount of a valve (19), said valve lift-changing mechanism (33) being capable of adjusting a tappet clearance in accordance with a change in lift amount of the valve (19), wherein said valve lift-changing mechanism (33) includes a rocker arm (63) having a valve abutment (70) abutting against a stem end of the valve (19) and a cam abutment (65) abutting against a valve-operating cam (69), a first link (61) pivotally supported at one end on the rocker arm (63) at a first fulcrum (64) and at the other end on an engine body (29) at a second fulcrum (67), a second link (62) pivotally supported at one end on the rocker arm (63) at a third fulcrum (66) and at the other end on the engine body (16) at a fourth fulcrum (68*a*), and a crank member (68) for swinging the fulcrum (68*a*) for pivotally supporting said other end of at least one (62) of the first and second links (61, 62) about an axis (C2) parallel to an axis of rotation of a valve-operating cam (69), said axis (C2) about which the crank member (68) is swung being eccentric (by δ) with respect to an axis (C1) of the fulcrum (66) for pivotally supporting said one end of said at least one link (62).

2. The engine valve operating system according to claim 1, wherein the tappet clearance is decreased in accordance with a decrease in lift amount of the valve (19).

3. An engine valve operating system comprising a valve lift-changing mechanism 33 for continuously changing the lift amount of a valve (19), said valve lift-changing mechanism (33) including a rocker arm(63) operatively associated with the valve (19) and two links (61, 62) which are connected, one at each end, to said rocker arm (63) and capable of swinging in response to a movement of the rocker arm(63), one (62) of said two links being pivotally supported at one end (68*a*) thereof, said one end(68*a*) being capable of swinging in response to an operational state of the engine, said valve lift-changing mechanism (33) being capable of adjusting a tappet clearance in accordance with a change in lift amount of the valve (19), wherein said rocker arm (63) has a valve abutment (70) abutting against a stem end of the valve (19) and a cam abutment (65) abutting against a valve-operating cam (69), said first link (61) of said two links is pivotally supported at one end on the rocker arm (63) at a first fulcrum (64) and at the other end on an engine body (29) at a second fulcrum (67), said second link (62) of said two links as said one link pivotally supported at another end on the rocker arm (63) at a third fulcrum (66) and at said end on the engine body (16) at a fourth fulcrum (68*a*), and a crank member (68) is provided for swinging the fourth fulcrum (68*a*) for pivotally supporting said one end of the one link (62) about an axis (C2) parallel to an axis of rotation of the valve-operating cam (69), said axis (C2) about which the crank member (68) is swung being eccentric (by δ) with respect to an axis (Cl) of the third fulcrum (66) for pivotally supporting said another end of said one link (62).

4. The engine valve operating system according to claim 3, wherein the tappet clearance is decreased in accordance with a decrease in lift amount of the valve (19).

* * * * *